US005954208A

United States Patent [19]

Schultz

[11] Patent Number: 5,954,208

[45] Date of Patent: Sep. 21, 1999

[54] HOLDER FOR REMOTE CONTROL UNITS

[76] Inventor: Donald F. Schultz, 377 E. 16th Pl., Unit A, Costa Mesa, Calif. 92627

[21] Appl. No.: 08/845,878

[22] Filed: Apr. 28, 1997

[51] Int. Cl.[6] ..... A47F 5/00

[52] U.S. Cl. ..... 211/13.1; 211/13.1; 211/26.1; 174/52.1; 174/52.4; 361/752; 361/756; 361/810; 206/305; 206/320; 248/671; 248/176.1; 248/205.2

[58] Field of Search ..... 361/810, 752, 361/756; 174/52.1, 52.4; 206/305, 320; 211/13.1, 26.1; 248/671, 176.1, 205.2

[56] References Cited

U.S. PATENT DOCUMENTS

| | | | |
|---|---|---|---|
| 4,739,897 | 4/1988 | Butler | 220/504 |
| 4,852,746 | 8/1989 | Wells et al. | 211/13.1 |
| 5,370,241 | 12/1994 | Silvers | 211/13.1 |
| 5,408,044 | 4/1995 | Spiegel | 174/52.1 |
| 5,615,768 | 4/1997 | Schermerhorn | 206/305 |
| 5,632,385 | 5/1997 | Mantey | 211/26.1 |

*Primary Examiner*—Leo P. Picard
*Assistant Examiner*—David Foster

[57] ABSTRACT

A holder for multiple remote control units includes a plurality of generally planar tiers pivotally coupled to a cylindrical support at one end. The tiers are pivotable to separate at angular positions and secured by an elongated fastener or the like. Embodiments are shown having two and three tiers. A plurality of hook and loop fabric fasteners are secured to the upper surfaces of each receiving tier and to the undersurfaces of the to-be-secured remote control hand units. In its preferred form, the holder is fabricated using a planar member having an aperture at one end thereof together with at least one member having a planar element including a cylindrical support having a passage defined therein. A threaded insert is press fitted within the passage to permit the attachment between the cylindrical support and the remaining structure using a threaded fastener. An extending base member forms a base extension for the bottommost planar tier for supporting the holder against tipping.

9 Claims, 1 Drawing Sheet

2
45
62
63
12
13
43
44
40
41
42
15
11
30
18
55
22
23
14
46
16
17
10
24
20
21
27
28
47
60
61

50
52
62
12
63
40
44
43
13
41
42
51
15
60
61
11
53
16
17
14
74
73
75
70
72
36
37
38
24
23
77
32
31
76
20
21
22
18
10

63
62
12
52
15
50
61
60
53
11
16
51
17
37
13
36
75
14
28
30
27
74
55
23
18
24
20
76
77
10
21
22

18
55
50
52
11
66
65
20

81
85
80
84
86
83
82
63
61
60
13
62
11
50
14
51
15
12
16
17
75
74
76
77
18
36
30
37
23
24
28
27
21
20
22

HOLDER FOR REMOTE CONTROL UNITS

FIELD OF THE INVENTION

This invention relates generally to consumer electronic devices and particularly to those utilizing remote control operation.

BACKGROUND OF THE INVENTION

For many years, consumer electronic devices such as televisions, stereos, video cassette recorders, compact disc players and tape cassette players have enjoyed increased development of remote control systems to the point where virtually all such devices are available with remote control capability. The fabrication and design of such remote control units has become extremely commonplace and most include a small elongated relatively thin plastic housing having an upper face supporting a plurality of control buttons and an internally supported battery powered infrared information sending device. On the receiving consumer electronic device, an infrared responsive receiver decoders interprets the encoded infrared signals and decodes the encoded operational command producing the desired result in the unit itself.

Such remote control units initially were implemented as relatively large often cumbersome devices. However, the continued application of advancing technology has produced control devices which are smaller than a typical cigarette package. In addition, the number of control features within the remote control hand unit itself have greatly increased as the technology has been refined.

Concurrent with the development of smaller and more sophisticated control units, the general increase in the number of consumer electronic devices of the type utilizing remote control has increased dramatically. With this increased popularity and use, the remote control unit has transitioned from an optional often luxury item on a consumer electronic device to commonplace standard equipment. In line with this marketplace and product transition, consumer electronic devices have become configured and designed in anticipation of remote control operation rather than the manipulation of a plurality of front cabinet buttons, knobs and other controls. Thus, consumers no longer utilize such remote control units sparingly but rather depend upon them as their main interface with the consumer electronic device.

One helpful device is marketed by Absolute Engineering Co., under the trademark "REMOTE REVOLT", which is a dba of the applicant of this application. The device provided, which was invented by the applicant includes a first generally planar member defining first and second ends; a second member defining a generally planar portion, a first end, a second end, and an upwardly extending boss proximate the first end; fastening means coupled between the first end of the first member and the boss to form a pivotal attachment therebetween; and attachment means for attaching a remote control unit to the first member and the planar portion of the second member.

The result of all this has been a virtual explosion in the proliferation of small compact lightweight remote control units. The typical home today will likely have two, three or more of such devices in use within any recreation or entertainment room. One of the problems with such remote control units is their tendency to become misplaced as consumers move about the room in other activities. In addition, such remote control units have become very similar in appearance and are often hard to distinguish from each other. Beyond this, a plurality of such remote control units collected upon a single table or the like often give the tabletop a cluttered look which users find undesirable but seem to have accepted as a fact of high technology life.

There remains, therefore, a need in the art for devices which will properly organize and coordinate the use of such multiple remote control units while facilitating their collection at a common place.

SUMMARY OF THE INVENTION

Accordingly, it is a general object of the present invention to provide an improved holder for multiple remote control units. It is a more particular object of the present invention to provide an improved holder for multiple remote control units which configures the remote control units in an organized arrangement. It is a still more particular object of the present invention to provide an improved holder for multiple remote control units which facilitates the removal and replacement of remote control units with the control unit array.

In accordance with present invention, there is provided for use in combination with a plurality of remote control units each having respective undersurfaces, a holder comprises: a first generally planar member defining first and second ends; a second member defining a generally planar portion, a first end, a second end, and an upwardly extending boss proximate the first end; fastening means coupled between the first end of the first member and the boss to form a pivotal attachment therebetween; and attachment means for attaching a remote control unit to the first member and the planar portion of the second member.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
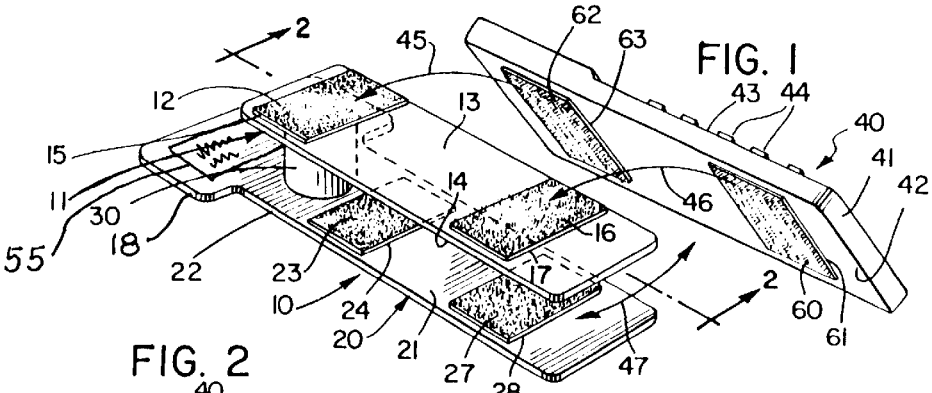
FIG. 1 sets forth a perspective view of a remote control unit holder constructed in accordance with the present invention receiving a typical remote control unit.

FIG. 1 sets forth a perspective view of a holder for remote control units constructed in accordance with the present invention and generally referenced by numeral 10. Holder 10 includes an upper plate 11 defining a generally planar member having an upper surface 13 and an undersurface 14. Upper plate 11 is preferably formed of a molded plastic material or the like and as is better seen in FIG. 2, defines an aperture 50 at one end thereof. A pair of fiber attachment pads 12 and 16 are secured to upper surface 13 of plate 11 by conventional adhesive layers 15 and 17 which secure fiber attachment pads 12 and 16 tightly to upper surface 13 of plate 11.

Control unit holder 10 further includes a lower plate 20 having a generally planar configuration and defining a planar upper surface 21 and an undersurface 22. Lower plate 20 further defines an upwardly extending cylindrical support member 30. In accordance with the present invention, lower plate 20 further defines a base extension 18 having outwardly extending ends 19 and 29. Base extension 18 supports an indicia 55 which may include instructional, decorative or commercial information. In addition, base extension 18 supports control unit 10 securely upon tabletop surfaces and the like.

In its preferred form, lower plate 20 is fabricated as a single integral molded plastic unit having cylindrical support 30 formed in one piece with lower plate 20. A pair of fiber attachment pads 23 and 27 are secured to upper surface 21 of lower plate 20 by conventional adhesive layers 24 and 28 respectively.

In accordance with an important aspect of the present invention, cylindrical support 30 provides a predetermined spacing between upper plate 11 and lower plate 20 and by means set forth below in greater detail, permits a pivotal attachment between the end portion of plates 11 and 20. In further accordance with the present invention, a typical remote control hand unit generally referenced by numeral 40 is fabricated in accordance with conventional fabrication techniques and includes an elongated generally planar body 41 having a planar undersurface 42 and an upper surface 43. A plurality of user operated control buttons 44 are supported upon upper surface 43 and operate in accordance with typical remote control operation. In further accordance with the present invention, a pair of fiber attachment pads 60 and 61 are secured to undersurface 42 of controller 40 using conventional adhesive material layers 61 and 63 respectively. In their preferred form, fiber attachment pads 12, 16, 23 and 27 of controller unit 10 comprise pads which support fiber attachment elements complimentary with those of fiber attachment pads 60 and 62 of remote control unit 40. For example, the fiber attachment pad supported upon holder 10 may comprise the loop portions of the popular hook and loop fabric attachment devices while the fiber attachment pads of controller 40 may comprise the hook portions of such hook and loop pads. Thus, remote control hand unit 40 is attachable to upper surface 13 of holder 10 by placing control unit 40 in an overlying position above upper surface 13 such that fiber attachment pads 60 and 62 are aligned with and overlie attachment pads 16 and 12 respectively. Thereafter, control unit 40 is secured to upper surface 13 of holder 10 by simply pressing controller 40 in place. While the present invention, in its preferred form, contemplates the use of such convenient hook and loop fiber attachment mechanisms for securing controllers such as controller 40, it will be apparent to those skilled in the art that a variety of attachment mechanisms may be utilized without departing from the spirit and scope of the present invention.

Figure 2:
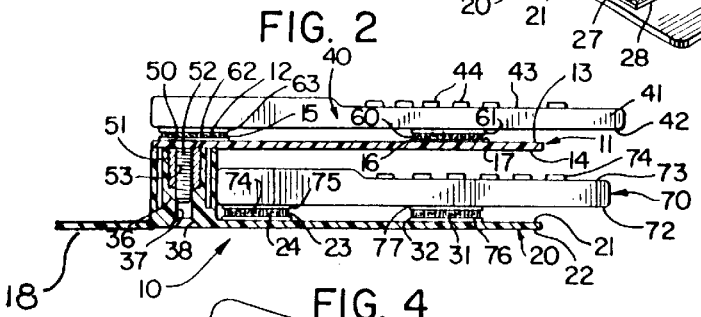
FIG. 2 sets forth a section view of the present invention remote control unit holder taken along section lines 2—2 in FIG. 1.

As is better seen in FIG. 2, a second hand control unit 70 may be similarly secured to upper surface 11 of lower plate 20 to complete the control unit assembly for holder 10. The removable attachment between the control units and holder 10 permits the periodic replacement of batteries or exchange of units often desired by consumers. As is described below in greater detail, the attachment between cylindrical support 30 and upper plate 11 provides a pivotal attachment which permits upper plate 11 and lower plate 20 to pivot with respect to each other in the directions indicated by arrow 47. In this manner, the controls supported upon the underlying hand controller (such as controller 70 in FIG. 2) may be rendered accessible by simply pivoting upper plate 11 with respect to lower plate 20 in the manner shown in FIG. 4 thereby exposing the upper control surface and control buttons of the control unit secured to lower plate 20. In the aligned position shown in FIG. 1, however, it should be noted that the combination of holder 10 and a pair of remote control hand units such as units 40 and 70 when properly secured to upper plate 11 and lower plate 12 present an extremely compact configuration which easily stores, occupies very little space, and may be easily carried by persons having small hands such as young children or by persons having limited hand flexibilities such as older viewers or the like.

FIG. 2 sets forth a section view of the present invention holder for multiple remote control units taken along section lines 2—2 in FIG. 1. As described above, remote control 10 includes an upper plate 11 defining a generally planar member having an upper surface 13 and an undersurface 14. Upper plate 11 defines a chamford aperture 50 and receives and supports a pair of fabric attachment pads 12 and 16 secured to upper surface 13 by conventional adhesive layers 15 and 17. Holder 10 further includes a lower plate 20 having an upper surface 21, an undersurface 22, a base extension 18 and an upwardly extending generally cylindrical support 30. Support 30 defines a center boss 36 having a passage 37 defined therein. Passage 37 defines a chamford surface 38 extending inwardly from undersurface 22. Holder 10 further includes a threaded insert 51 defining a plurality of internal threads 53. As is better seen in FIG. 3, threaded insert 51 is press-fitted within passage 37. Lower plate 20 further includes fiber attachment pads 31 and 33 secured to upper surface 21 by a pair of adhesive layers 32 and 34 respectively. A threaded fastener 52 defines a chamford head received within chamford aperture 50 and is threadably engaged with threads 53 of threaded insert 51. The attachment of fastener 52 provides a pivotal attachment between upper plate 11 and cylindrical support 30 of lower plate 20. Thus, upper plate 11 and lower plate 20 are pivotally attached in the manner shown in FIG. 4 and may be pivoted to virtually any angular position. In its preferred form, holder 10 has attachment pad 12 positioned overlying aperture 50 to provide a convenient covering for the otherwise exposed head of fastener 52.

In accordance with the present invention, holder 10 receives hand controllers 40 and 70 constructed in accordance with conventional fabrication techniques. Thus, as described above, remote control 40 includes a body 41 having an undersurface 42, an upper surface 43 and a plurality of control buttons 44. Controller 40 supports a pair of attachment pads 60 and 62 secured to undersurface 42 by adhesive layers 61 and 63 respectively. In accordance with the present invention, controller 40 is received upon and secured to upper plate 11 through the cooperation of fabric attachment pads 60 and 62 with pads 16 and 12 respectively. The entire combination is rested in a stable manner and resists tipping by the presence of base extension 18.

Similarly, hand controller 70 also constructed in accordance with conventional fabrication techniques includes a body 71 having an undersurface 72, an upper surface 73 and supporting a plurality of control buttons 74. Controller 70 further includes a pair of attachment pads 74 and 76 secured to undersurface 72 by adhesive layers 75 and 77 respectively.

Figure 3:
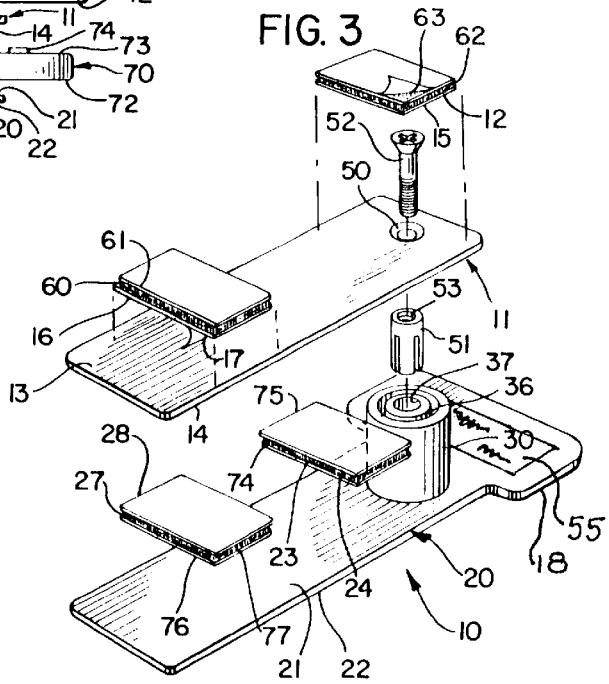
FIG. 3 sets forth a perspective assembly view of a remote control unit holder constructed in accordance with the present invention.

FIG. 3 sets forth a perspective assembly view of holder 10. Holder 10 includes upper plate 11 defining a generally planar member having upper surface 13, undersurface 14 and a chamford aperture 50 formed therein. Attachment pads 62 and 12 having adhesive layers 63 and 15 respectively together with attachment pads 60 and 16 having respective adhesive layers 61 and 17 are securable to attach a remote control unit such as unit 40 to upper surface 13 in the manner set forth above. Holder 10 further includes lower plate 20 having a base extension 18 having ends 19 and 29 and an indicia 55. A cylindrical support 30 defining an interior boss 36 is also formed on lower plate 20. Boss 36 defines an interior passage 37 which receives a threaded insert 51 having threads 53 defined therein. A pair of attachment pads 74 and 23 together with a pair of attachment pads 76 and 27 having adhesive layers 77 and 28 respectively are utilized to secure a hand controller such as hand controller 70 to upper surface 21 of lower plate 20 in the manner described above. Thereafter, with upper plate 11 positioned such that aperture 50 is aligned with threaded insert 51, fastener 52 is passed through aperture 50 and threadably received within threaded insert 51 using cooperating threads 53. Fastener 52 is tightened to the desired tightness to provide a slight resistance to pivotal motion of upper plate 11 with respect to cylindrical support 30. As set forth above in its preferred fabrication, the head of fastener 52 and aperture 50 of upper plate 11 are covered with fabric attachment pad 12 for appearance and to preclude tampering with fastener 52.

Figure 4:
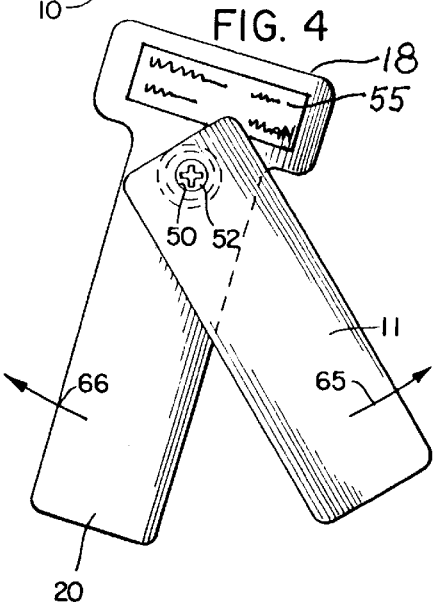
FIG. 4 sets forth a bottom view of the present invention remote control unit holder.

FIG. 4 sets forth upper plate 11 and lower plate 20, having base extension 18, secured by fastener 50 showing the pivotal motion therebetween as exemplified by movement in the direction indicated by arrows 65, and 66.

Figure 5:
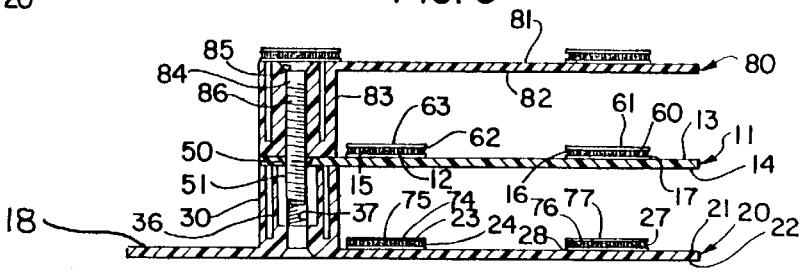
FIG. 5 sets forth a section view of an alternate embodiment of the present invention remote control unit holder.

FIG. 5 sets forth an alternate embodiment of the present invention in which an additional third plate 80 is added to upper plate 11 and lower plate 20 to provide a three-tiered holder capable of holding a third remote control unit. Thus, upper plate 11 and lower plate 20 are configured in the manner set forth above. Additional plate 80 is identical to lower plate 20 with the omission of threaded insert 51 and base extension 18. Thus, upper plate 80 defines an upper surface, an undersurface 82 and a cylindrical support 83. Support 83 defines a passage 84 and a chamford surface 85. It should be noted that plate 80 while similar to lower plate 20 with the omission of threaded insert 51. Thus, upper plate 80 defines an upper surface 81, an undersurface 82 and a cylindrical support 83. Support 83 defines a passage 84 and chamford surface 85. It should be noted that plate 80 while identical to lower plate 20 with the exception that no threaded insert has been placed within passage 84 is secured to upper plate 11 and lower plate 20 in an inverted position thus captivating plate 11 between plates 20 and 80. A threaded fastener 56 having sufficient length to extend through cylindrical support 83, upper plate 11 and a portion of insert 51 is received within passage 84 of cylindrical support 83. Thus, fastener 86 extends through passage 84, aperture 50 in plate 11 and partially into threaded fastener insert 51. Within insert 51, fastener 86 engages threads 53 thereof to provide a secure attachment. Fastener 86 is tightened sufficiently to tightly captivate upper plate 11 in a compressive attachment while nonetheless permitting pivotal motion of plates 80, 11 and 20 with respect to each other in the manner set forth above thereby exposing the desired remote controller.

The embodiment of FIG. 5 shows the advantageous qualities of base extension 18 in preventing tipping of the present invention holder. The extending structure of ends 19 and 29 stabilize the holder which would otherwise be "top-heavy". Place on a flat surface, the holder is maintained in an upright position by base extension 18. In addition, indicia 55 on the upper surface of base extension 18 provides a convenient location for information such as channel numbers or index of each remote control in the stacked arrangement of holder 10.

It will be apparent to those skilled in the art that while FIG. 5 shows a three-tiered configuration, the present invention holder may be fabricated using a plurality of additional plates such as plate 80 with extended fasteners in place of fastener 86 to provide a virtually unlimited number of tiers. It has been found, however, that a three-tiered or two-tiered embodiment meets the needs of the majority of consumers.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in combination with a plurality of remote control units each having respective undersurfaces, a holder comprising:

a first generally planar member defining first and second ends;

a second member defining a generally planar portion, a first end, a second end, and an upwardly extending boss proximate said first end;

fastening means coupled between said first end of said first member and said boss to form a pivotal attachment therebetween;

attachment means for attaching a remote control unit to said first member and said planar portion of said second member; and an extending base member formed on said second member and extending from said first end thereof.

2. For use in combination with a plurality of hand holdable remote control units, a holder comprising:

a plurality of generally planar tier portions having remote control unit receiving surfaces;

pivotal support means coupled to said tier portions and supporting them in a spaced apart generally parallel array in which one of said tier portions is the bottommost in said array;

control unit attachment means securing one of said control units to each of said tier portions; and an extending base member formed on said bottommost tier portion and extending away from said pivotal support means.

3. A holder as set forth in claim 2 wherein said tier portions are elongated and each define a first end coupled to said pivotal support means and a second end extending oppositely therefrom.

4. A holder as set forth in claim 3 wherein said pivotal support means includes a support at said first end of at least one of said tier portions extending from said receiving surface and supporting an adjacent tier portion.

5. A holder as set forth in claim 4 wherein said pivotal support means includes a fastener received within said support and captivating said at least one tier portion.

6. For use in combination with a plurality of hand holdable remote control units, a holder comprising:

a first planar member defining first and second ends and a first control unit receiving surface;

a second planar member defining third and fourth ends, a second control receiving surface and a first extending support at said third end;

pivotal attachment means coupled between said first extending support and said first end of said first planar member pivotally attaching said first planar member to said first extending support to maintain said first and second control unit receiving surfaces in a spaced generally parallel arrangement; and control unit attachment means securing control units to said first and second control unit receiving surfaces.

7. A holder as set forth in claim 6 wherein said extending support defines a first passage and said first end of said first planar member defines an aperture and wherein said pivotal attachment means includes a threaded fastener extending through said aperture and into said first passage.

8. A holder as set forth in claim 7 further including a third planar member defining fifth and sixth ends, a second extending support at said fifth end and a third control unit receiving surface secured to said first planar member in a pivotal attachment.

9. A holder as set forth in claim 8 wherein said second extending support defines a second passage and wherein said fastener passes therethrough and through said aperture and into said threaded passage to captivate said first planar member between said first and second extending supports.

* * * * *